US008820387B2

(12) United States Patent
Zettl

(10) Patent No.: US 8,820,387 B2
(45) Date of Patent: Sep. 2, 2014

(54) WINDING DEVICE FOR COVERING WALL OPENINGS OR WINDOWS

(75) Inventor: Horst Zettl, Wallersdorf (DE)

(73) Assignee: Lock Antriebstechnik GmbH, Ertingen (DE)

( * ) Notice: Subject to any disclaimer, the term of this patent is extended or adjusted under 35 U.S.C. 154(b) by 3 days.

(21) Appl. No.: 13/381,782

(22) PCT Filed: Jul. 6, 2010

(86) PCT No.: PCT/EP2010/004082

§ 371 (c)(1),
(2), (4) Date: Dec. 30, 2011

(87) PCT Pub. No.: WO2011/003576

PCT Pub. Date: Jan. 13, 2011

(65) Prior Publication Data

US 2012/0138243 A1 Jun. 7, 2012

(30) Foreign Application Priority Data

Jul. 9, 2009 (DE) ..... 20 2009 005 007 U

(51) Int. Cl.
*E06B 9/66* (2006.01)

(52) U.S. Cl.
USPC ..... 160/244; 160/319

(58) Field of Classification Search
USPC ..... 160/243, 322, 244, 170, 319
See application file for complete search history.

(56) References Cited

U.S. PATENT DOCUMENTS

| | | | | | |
|---|---|---|---|---|---|
| 75,037 | A | * | 3/1868 | Matchett | 160/241 |
| 108,752 | A | * | 11/1870 | Beal | 160/243 |
| 112,814 | A | * | 3/1871 | Kennedy | 160/244 |
| 119,983 | A | * | 10/1871 | Hobart | 160/244 |

(Continued)

FOREIGN PATENT DOCUMENTS

FR 2563860 A1 5/1984

OTHER PUBLICATIONS

International Search Report for PCT/EP2010/004082—English Translation.
International Search report for PCT/EP2010/004082.

*Primary Examiner* — David Purol
(74) *Attorney, Agent, or Firm* — Burr & Brown, PLLC

(57) ABSTRACT

The invention relates to a winding device and to a method for covering wall openings or windows. The winding device comprises a covering element that can be rolled up, a deflecting element that has a wave-like design, or is simply formed by a bottom hemline, or a bottom woven fabric edge and/or longitudinal edge, and at least on raising and lowering unit. In addition, the covering element is provided with an upper longitudinal edge, which is preferably arranged in parallel to the deflecting element. The lower longitudinal edge is either connected to the deflecting element, or is formed by the same, so that as a result of a rotation of the deflecting element, or of the lower woven fabric edge and/or longitudinal edge, about a horizontal axis, the covering element can be rolled up or down. The raising and lowering unit comprises at least one cord, wherein at least one free end of the cord is connected to the raising and lowering unit. The cord is arranged such that it encloses the covering element, so that the deflecting element, or the lower longitudinal edge, is guided in the bend of the cord. The at least one cord can be guided in two opposite directions of movement that are relative to one another.

17 Claims, 14 Drawing Sheets

(56) References Cited

U.S. PATENT DOCUMENTS

| | | | | | |
|---|---|---|---|---|---|
| 257,826 | A | * | 5/1882 | McCutchen | 160/244 |
| 1,181,120 | A | * | 5/1916 | Douthitt et al. | 160/243 |
| 1,225,060 | A | * | 5/1917 | Russell | 160/243 |
| 1,464,412 | A | * | 8/1923 | Dillon | 160/304.1 |
| 1,473,517 | A | * | 11/1923 | Richards | 160/243 |
| 1,870,920 | A | * | 8/1932 | McNulty | 160/244 |
| 2,582,276 | A | | 1/1952 | Powers | |
| 5,785,105 | A | | 7/1998 | Crider et al. | |
| 5,819,835 | A | * | 10/1998 | Broome | 160/243 |
| 6,138,739 | A | * | 10/2000 | Crider et al. | 160/273.1 |
| 6,273,813 | B1 | | 8/2001 | Arntjen | |
| 2004/0060670 | A1 | | 4/2004 | Judkins | |

* cited by examiner

WINDING DEVICE FOR COVERING WALL OPENINGS OR WINDOWS

CROSS REFERENCE TO RELATED APPLICATIONS

This application is a national stage filing of PCT/EP2010/004082, filed on Jul. 6, 2010, which in turn claims priority to DE 20 2009 005 007.6, filed on Jul. 9, 2009

BACKGROUND OF THE INVENTION

1. Field of the Invention

The present invention relates to a winding device for covering wall openings or windows according to the characteristics of the preamble of claim 1.

2. Description of Related Art

Prior art shows winding devices that can be wound up and unwound in a vertical direction. Such winding devices are used for instance for a variable shielding of rooms, for a variable ventilation and/or for a separation of stables, green houses or something alike. Such winding devices usually comprise a flexible fabric or canvas as covering element. Prior art furthermore shows winding coils onto which the flexible fabric can be wound.

Such a winding device is known from DE 201 17 865 U1, Flexible fabric 2 is wound onto a motor-driven bottom shaft 4. During the winding process the shaft 40, which is rotatable about a horizontal axis D, is moved upwards in a vertical direction. The upper end of the flexible fabric 2 is connected with cords 25 to a second shaft. The second shaft is also called coil body 24. A fixed gap opening is located between the second shaft 24 and the fabric 2. In this winding device the fabric 2 has to carry the weight of the shaft during the winding process. This leads to tension on the fabric 2. Under certain unfavourable circumstances the fabric 2 can be damaged due to this stress. Furthermore the diameter of the shaft 4 increases during the winding process because of the gradually increasing amount of fabric that is wound onto the shaft. This results in an accelerated movement of the fabric 2 during the winding process, when a constant rotational speed of the rotating shaft 4 is maintained.

Over the years, various efforts have been made to compensate the increasing diameter in the course of the winding process and the concomitant increase in speed. DE 202 14 076 U1 shows a device for shielding a room with an upper and a lower winding system. The difference in diameter between the upper and the lower winding element is compensated by special fixing devices. In practice winding devices are desirable that do not require any additional elements like fixing elements or something similar to compensate the increasing diameter.

A further winding device is shown in GB 2 431 190 A. Hereby the fabric material 1 is arranged between two shafts 2 and 3, whereby each of the shafts can perform a translational and rotational movement. The adjustment of the size and position of the fabric 1 is effected by corresponding movements of the two shafts 2 and 3.

SUMMARY OF THE INVENTION

An object of the invention is to provide a universal winding device for covering wall openings or windows with a simple and affordable construction, whereby the fabric can be easily wound up and unwound.

The above object is achieved by the device and a method comprising the features of claims 1 and 16.

The winding device according to the invention comprises a covering element that can be rolled up or wound up, a deflecting element that has a wave-like design or that is simply formed by the bottom hemline or the bottom longitudinal edge of the covering element and at least one raising and lowering unit. The covering element furthermore comprises an upper longitudinal edge that is preferentially arranged parallel to the deflecting element. The bottom longitudinal edge is either connected to the deflecting element or formed by the deflecting element. The covering element can be wound up or unwound by a rotation of the deflecting element or by a rotation of the bottom longitudinal edge about a horizontal axis. The raising and lowering unit comprises at least one cord, whereby at least one free end of the cord is connected to the raising and lowering unit. The cord is arranged in such a way that it encloses the covering element, whereby the deflecting element or the bottom longitudinal edge is guided in the bend of the cord. The at least one cord can be guided to perform two relatively opposite directions of movement. According to a preferred embodiment the cord can be connected to the upper longitudinal edge of the covering element.

In the present context the term cord must be interpreted widely with respect to its conceptual definition and is not limiting. Chain-like structures or other deflectable, elongated connecting elements can be used instead. Ribbons, strips, broad sections of fabric or something alike can also be used and should therefore be included when the term cord is used.

The deflecting element or the bottom longitudinal edge are arranged at the lowest point and held and guided in the bend of the cord. The bottom longitudinal edge or the deflecting element is put into a rotational motion by a movement of the cord. Thereby the fabric or curtain is automatically wound up. In particular, the deflecting element or the bottom longitudinal edge can be rotated by the movement of the at least one cord in two relatively opposite movement directions.

The at least one cord can be guided in at least two approximately parallel movement directions relatively opposite to each other. The cord guides the deflecting element or the bottom longitudinal edge together with the covering element, which is thereby wound up or unwound. The covering element is put into rotation by the movement of the cord, thereby the fabric or curtain is rolled up or unwound. The cords can also be arranged in an oblique fashion, whereby the function of the invention is not impaired or limited in any way. In another advantageous embodiment of the invention the cords are arranged in V-shape. This can for instance be especially advantageous when the cords are wound up or it can be advantageous regarding the required space. The selected embodiment especially takes into account the existent installation space as well as the preferred or required winding translation.

The winding device according to the invention can be used for covering wall openings or windows, especially in stables or green houses. The covering element that is rolled up can for instance be made from fabric or from plastic lamella that are interconnected or from something alike.

The deflecting element with the wave-like design can optionally comprise guiding grooves or radial grooves or the like for the initial guidance of the cords. The covering element that is wound onto the deflecting element or onto the hem of the covering element encloses the deflecting element or the hem already after a short rotation. This especially means that after the rotation the cord is not in contact with the grooves or radial grooves any longer. Optionally the grooves can therefore also be omitted. Regarding its length and diameter of the deflecting element a plurality of variations is possible.

The width of the covering element and thus the length of the deflecting element are preferentially defined by the width of the opening to be covered. Widths of several meters can be easily covered by a parallel and spaced arrangement of several cords, which are arranged beside each other across the entire width of the covering element. Especially widths of several meters can be covered without a sagging or bending of the deflecting element. As the bottom longitudinal edge can be constructed very lightly, the risk of a bending is very small anyway. The bottom longitudinal edge is preferentially not connected to any shaft and therefore it must not show any load-bearing properties. Therefore a stable and thus heavy construction is not required.

The at least one cord can—as has been described already—be connected to a raising and lowering unit with at least one of its free ends. In certain embodiments of the invention the cord can additionally be connected to the upper longitudinal edge of the covering element. By lowering or lifting or raising the at least one cord, the upper edge of the fabric or the upper longitudinal edge of the covering element is raised or lowered.

The winding or lifting of the cord comprises a relative movement of the two cord sections arranged in parallel. This cord movement causes the rotation of the winding or deflecting element and therefore the winding or unwinding of the covering element. This produces a relative movement of the deflecting element or of the bottom longitudinal edge by an opposite movement of the two sides of the cord.

The covering element comprises an upper longitudinal edge and a bottom longitudinal edge, whereby the bottom longitudinal edge is preferentially arranged in parallel to the deflecting element or forms the deflecting element. The longitudinal edges can additionally be provided with reinforcements for further stabilization.

As already mentioned several times, the bottom longitudinal edge of the covering element can be connected with the deflecting element or the bottom longitudinal edge of the covering element forms the deflecting element. By a rotation of the deflecting element or the bottom longitudinal edge about a horizontal axis, the covering element can be wound up around the deflecting element or around the bottom longitudinal edge. The horizontal axis hereby runs through the deflecting element. The connection between the deflecting element (if any) and the bottom longitudinal edge of the covering element may be subject to a number of design variations. The connection can for instance be formed by screw joints, rivet-bonded joints or adhesive bonds.

In another preferred embodiment, the raising and lowering unit is formed by a shaft. In this embodiment at least one free end of the cord is connected to the shaft. If the shaft is now put in rotation, the cord as well as the covering element are lowered in a first working step. At the same time the covering element is wound onto the deflecting element. When the covering element is completely wound up, the deflecting element is then lifted upwards in a vertical direction in a second working step. There is no limitation regarding the number of cords used in the invention. Especially for covering elements with a bigger width several cords can be used.

According to an alternative embodiment, a cable pull may be provided instead of a shaft. This embodiment can also provide guiding rolls for deflecting the cord from a vertical movement direction into a horizontal movement direction.

The synchronous speed of winding and lifting the fabric is especially advantageous. The winding velocity of the covering element depends on the attachment of the cord. If at least one free end of the at least one cord is connected to a shaft arranged above the covering element, the winding velocity depends on the winding velocity of the cord that is used for the winding of the covering element and for the rotational movement.

The drive of the raising or lowering unit, especially the rotational movement of the shaft or the horizontal movement of the cable pull can also be produced manually. For this purpose a crank can be connected to the shaft. The crank can be used to produce the rotation of the shaft or the horizontal movements of the cable pull.

In further embodiments of the invention the drive for the raising or lowering unit is produced by a drive unit. The drive unit can be a motor, especially an electric motor.

In the context of the invention several cords with different functions can be used optionally. The device can for instance comprise at least one first cord and at least one second cord. The second cord can be provided for lifting and lowering the upper longitudinal edge, meanwhile the first cord can be provided for the winding of the covering element or for the winding and lifting or lowering of the covering element. Thereby it is possible to perform both processes independently. The cords can furthermore be power-optimized in terms of number, material and diameter. In the present context the term rope has to be widely understood in its conceptual definition.

A first free end of the second cord can for instance be connected to the raising and lowering unit, especially to a shaft. A second free end of the second cord can be connected to the upper longitudinal edge of the covering element. Both free ends of the first cord can for instance be connected to the raising and lowering unit, especially to a shaft.

Further embodiments are possible, whereby one of the free ends of the first cord is connected to the raising and lowering unit, for instance to a shaft, and whereby the second free end of the first cord is connected to the upper longitudinal edge of the covering element, whereby the first rope encloses the covering element. In this embodiment one free end of the second cord is connected to the raising and lowering unit, for instance to a shaft. The second free end of the second cord is connected to the upper longitudinal edge of the covering element.

This means that the covering element can be wound onto the winding device by a rotation of the deflecting element or by a rotation of the bottom longitudinal edge of the covering element. Particularly the winding is mostly complete. By lifting the at least one first cord and/or the at least one second cord the wound up covering element can additionally be raised or lifted.

It should be emphasized at this point that the deflecting element is not necessarily a rigid part or even a separate part of the winding device. The deflecting element can for instance be formed by the lower fabric hem or the lower fabric selvedge. This lower hem or selvedge is characterized by the linkage with the windable cords. When the cords move, the hem or selvedge is rotated in a defined direction. Thereby a relaxed roll-up or unwinding takes place.

The safe handling of the winding device according to the invention is particularly advantageous. Especially the acting forces are much smaller than in any other known winding device. A hand that is accidentally drawn into the winding device does not get injured because the cords would slip through and the fabric would not be wound up any further. Known systems require a much higher winding force for their winding shaft. The reason therefore is that the force can only be introduced into the shaft at the axial ends. Otherwise it would not be possible to roll up fabric with a width of up to 80 m. According to the invention the winding force can be inserted over the whole width of the fabric or curtain.

The first cord can additionally comprise fixation means or guiding means further stabilizing or protecting the winding device or the covering element against additional strain or burden. This additional strain or burden can for instance be produced by wind or suction. This so called wind protective means leads to a higher operational safety of the device. A connection between the lower turning point or bend of the cord and the ground or subsoil, which limits a lateral movement or deflecting of the covering element, can for instance be used as wind protective means. The at least one cord is especially guided through a tensioning device and/or fixed by the tensioning device. In this embodiment the lifting of the wound up covering element is not possible or only possible after loosening the wind protective means. Other additional means for wind protection can be reduced or even omitted completely.

Another advantage of the winding device can be explained for devices with interruptions, especially when several openings arranged beside one another should be covered with the winding device. Such interruptions especially occur on lateral walls which comprise exits, outbuildings or something alike. In winding devices according to prior art the required winding force is inserted laterally. Therefore a new drive unit is required after each interruption. Alternatively a new winding device has to be installed after each interruption. In the winding device according to the invention the rotation effect is applied to the deflecting element or the bottom longitudinal edge by the covering element. Therefore the covering element can be interrupted as often as necessary without the requirement of any additional drive units.

By using the device according to the invention with an optimized cord length, the described functionalities can be achieved particularly advantageous and economically feasible. The ideal cord length varies depending on the connection of the cord ends.

According to a preferred embodiment the ideal length of the first cord, which is connected to the raising and lowering unit with both free ends, corresponds approximately to the sum of three times the height of the covering element plus two times the distance between the upper longitudinal edge of the completely unwound covering element and the raising and lowering unit. The raising and lowering unit can for instance be formed by a shaft or a deflecting roll.

According to another embodiment the first end of the first cord is connected to the raising and lowering unit and the second end of the first cord is connected to the upper longitudinal edge of the covering element, whereby the cord is arranged in a way that is encloses the deflecting element. The ideal cord length corresponds approximately to the sum of two times the height of the covering element plus one times the distance between the upper longitudinal edge of the completely unwound covering element and the raising and lowering unit, for instance a shaft or a deflecting roll.

It is also possible to optimize the length of the second cord. According to a preferred embodiment the length of the second cord corresponds approximately to the sum of one times the height of the covering element plus one times the distance between the upper longitudinal edge of the completely unwound covering element and the raising and lowering unit.

For the functionality of the device it is further advantageous, when in the unwound state of the covering element each cord end, which is released during opening of the covering element, is wound up about one times the height of the covering element (if a shaft is used) or if the cord is stretched over a deflecting roll about a distance corresponding to one times the height of the covering element (if a cable pull technology is used). When the covering element is completely unwound, the working length of the at least one first and/or one second cord corresponds approximately to about the height of the completely unwound covering element.

It is obvious for the expert in the technical field that any longer or shorter or differently arranged working cords can lead to the same functions or partial achievement of the functions. Therefore the use of different cord lengths that ensure the functionality described by the invention are also in the scope of the present invention.

The invention furthermore relates to a method for winding a winding device described above. The deflecting element or the bottom longitudinal edge of the covering element can be rotated in two opposite movement directions by the movement of the at least one first cord. The covering element is wound up onto the deflecting element or bottom longitudinal edge by the rotation of the deflecting element or bottom longitudinal edge about a horizontal axis. After a first rotation about the deflecting element or about the bottom longitudinal edge a fabric roll is formed, that is now set in rotation. The velocity of the fabric roll depends on its outer diameter (circumference) and the velocity of the cord movement. The cord velocity preferentially corresponds to the velocity with which the upper longitudinal edge is raised or lowered. Therefore the rotational velocity is automatically adjusted according to the cord velocity.

Preferentially the covering element is completely wound up by the rotation of the deflecting element in one movement direction and raised by lifting the at least one first and/or at least one second cord.

According to the inventive method the winding and unwinding of the covering element is done only about the deflecting element or about the bottom longitudinal edge of the covering element. Contrary to the known winding devices the covering element is not rolled up about an upper longitudinal edge.

The function of the winding device according to the invention can therefore be summarized as follows: The upper edge of the fabric can be lowered or raised by at least one cord or band. The at least one cord or band is connected to a raising and lowering unit, for instance the cord is connected to a motor-driven winding shaft.

The bottom longitudinal edge can be reinforced with a stiffening element. The bottom fabric edge or bottom longitudinal edge can be put in rotation by the movement of at least one cord or band enclosing the bottom longitudinal edge. In particular, the cords are arranged in a way that they are lowered on one side of the covering element and raised on the other side of the covering element, forming a bend at the lowest point.

The lowering of the fabric edge or longitudinal edge and the generation of the rotational motion is preferentially done with the same or similar and steady velocity. Furthermore it may be provided that the wound up fabric is then raised by the cords. This requires an appropriate length of the cords. The winding and unwinding of the fabric and the lifting of the wound-up fabric roll can thereby be achieved with just one drive.

In the winding device according to the invention the transmission of the drive force required for the rotation, especially required for the winding and unwinding of the fabric, is effected onto the fabric or onto the bottom edge of the fabric from outside. Therefore the velocity with which the fabric is wound or unwound is usually constant.

In commonly known winding devices the transmission of the drive force required for the rotation is usually inserted at one or both ends of the winding means. Thereby the force must be transmitted over the entire length of the winding means, which requires much higher forces. There is also a danger of twisting. When the fabric is wound up, the diameter of the fabric roll increases. At a constant rotational speed of the winding means the speed of the fabric increases. This leads to tension on the upper longitudinal edge which is lowered with constant speed. These known winding devices therefore require two driving means—one at the upper edge and one at the lower edge. Alternatively a compensation element has to be integrated. These winding devices also always show a height offset of the lower fabric edge during winding or unwinding.

In contrast to the known winding devices, one of the main advantages of the winding device according to the invention is, that there is no danger of a twisted shaft. The length and width of the fabric used for the winding device is almost unlimited. Furthermore no height difference arises. The bottom longitudinal edge of the covering element always remains at the same height when the upper longitudinal edge is lowered. This is achieved by the winding bend formed by the cord, which holds and guides the bottom longitudinal edge. Furthermore there is no bending of the shaft. Because the device can be adapted by using higher numbers or stronger cords, the weight is also unimportant.

BRIEF DESCRIPTION OF THE DRAWINGS

The figures described in the following passages further illustrate exemplary embodiments of the invention and their advantages. Further characteristics, objects and advantages of the present invention are explained in the following description of a preferred embodiment of the invention, which is not intended to limit the scope of the invention.

DETAILED DESCRIPTION OF THE INVENTION

The same or equivalent elements of the invention are designated by identical reference numbers. Furthermore and for the sake of clarity, only the reference numbers relevant for describing the respective figure are provided. It should be understood that the embodiments described are only examples and they are not intended to limit the scope of the disclosure.

FIGS. 1*a* to 1*d* schematically show the operating mode of a first embodiment of a winding device according to the invention.

Figure 1A:
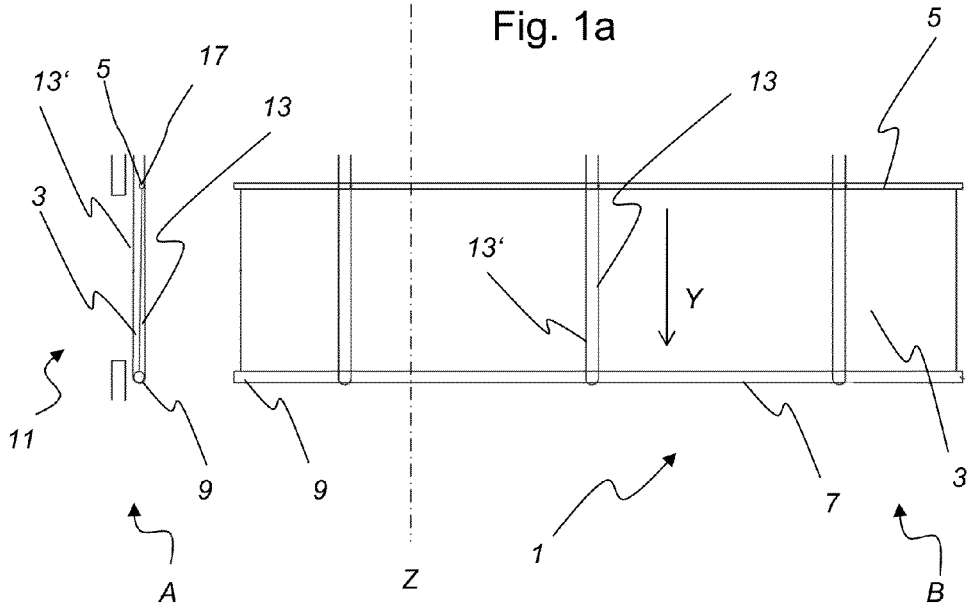
FIGS. 1*a* to 1*d* schematically show the operating mode of an embodiment of a winding device according to the invention.

FIG. 1*a* shows a winding device 1 as claimed by the invention. A side view A and a front view B is shown. The winding device 1 comprises a covering element 3 with an upper longitudinal edge 5 and a bottom longitudinal edge 7. The length of the covering element 3 is adapted according to the size of the wall opening 11 to be covered. The unwound covering element 3 optionally covers the wall opening 11 either partially or completely. The longitudinal edges 5 and 7 of the covering element 3 can comprise additional reinforcements. The bottom longitudinal edge 7 is firmly connected to the deflecting element 9. The deflecting element 9 is suspended between the cord sections 13 and 13'. The deflecting element 9 is wound up or down in the lower bend of the cord by the movement of the cord sections 13 and 13' in opposite directions. At the lower turning point the cord sections 13 and 13' form a bend, therefore the movement of the cord 13 causes a rotation of the deflecting element 9. The cord 13 or 13' is guided parallel to a vertical axis Z. The movement direction of the cord 13 during a downward movement is indicated by arrow Y in FIG. 1*a*. The cord 13 or 13' is connected to the upper longitudinal edge 5 of the covering element 3 at a connective joint 17.

Figure 1B:
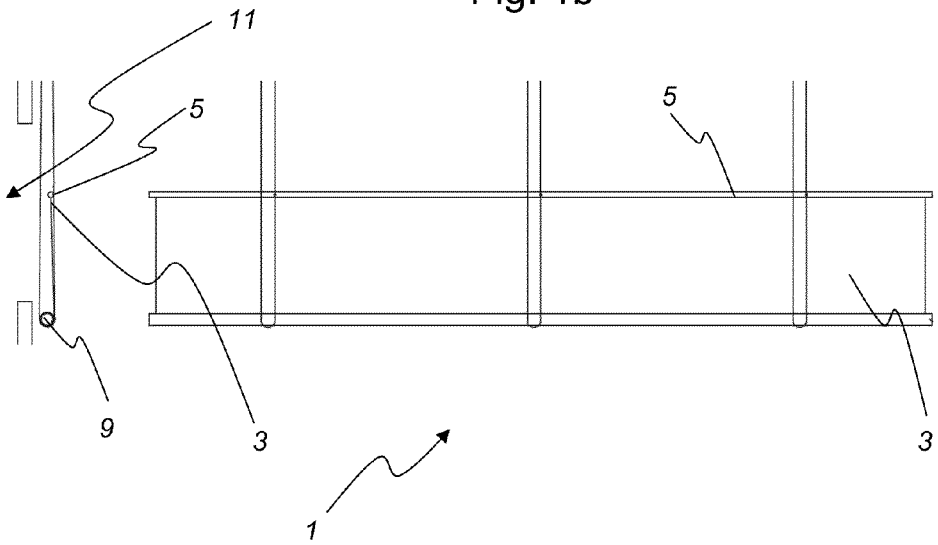
Figure 1C:
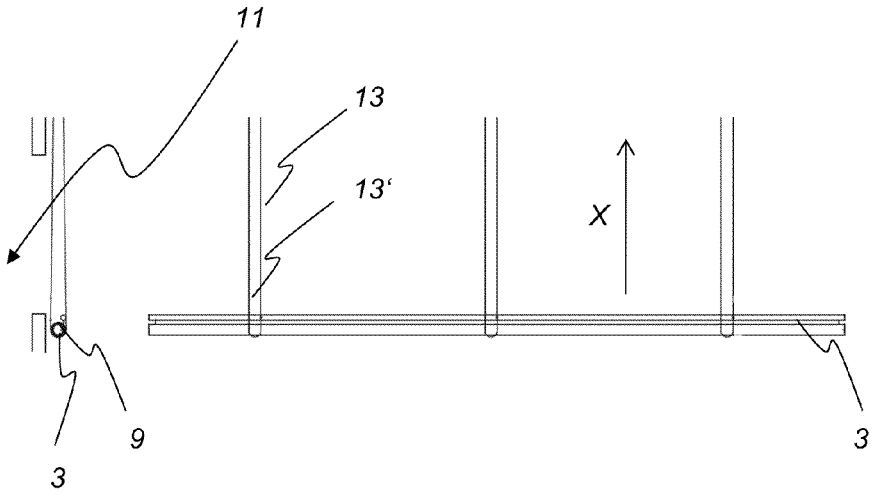

FIGS. 1*b* and 1*c* show the gradual process of transferring the winding device 1 from an open position shown in FIG. 1*a* to an initial position shown in FIG. 1*c*. In the open position according to FIG. 1*a* the wall opening is completely covered with the completely unwound covering element 3. In the initial position according to FIG. 1*c* the covering element 3 is in a completely wound-up or rolled-up state. In the initial position the wall opening is open, allowing a free air flow and air exchange between the inside of the building and the outside air.

The winding device 1 shown in FIG. 1*b* is only partially open. The covering element 3 is partially wound up onto the deflecting device 9. In FIG. 1*b* only the lower part of the wall opening 11 is covered by the covering element 3. The upper longitudinal edge 5 is guided parallel to a horizontal axis (not shown) in the movement direction indicated by arrow Y.

The rotational speed of the deflecting element 9 is not necessarily maintained constant during movement of the upper longitudinal edge 5 in the movement direction indicated by arrow Yin FIG. 1*a*. Instead, the rotational speed slows down when the diameter of the roll, which is formed by the deflecting element 9 and the covering element 3, increases.

Due to the inventive design of the device the rotational speed of the deflecting element is automatically adjusted to the changing diameter of the roll, which is formed by the deflecting element 9 and the covering element 3. The rotational speed is also adjusted when the diameter changes due to dirt, wrinkles or cold temperatures.

FIG. 1*c* shows a covering element 3 that has been completely wound up onto the deflecting element 9. The wall opening 11 is completely exposed. Starting from this state, the movement directions of the cords 13 and 13' are now being guided contrary to their previous movement direction. Thereby the open state of the winding device as shown in FIG. 1*a* can be restored. In order to convert the winding device from the initial position shown in FIG. 1*c* into the position shown in FIG. 1*d*, the movement direction of the cords is not retained. The lowering cord is now converted into a lifting cord instead. Thereby the deflecting element 9 together with the wound up covering element 3 is raised. It is also possible that a transfer into the position shown in FIG. 1*d* can also be performed, when the winding device is in another opening state. For example the deflecting element 9 can be raised, when only part of the covering element 3 is wound up onto the deflecting element 9, so that the winding device is only partially open as shown in FIG. 1*b*.

FIGS. 2*a* to 2*d* schematically show the operating mode of a further embodiment of a winding device 1 according to the invention, whereby the winding device 1 comprises a shaft 19.

Figure 1D:
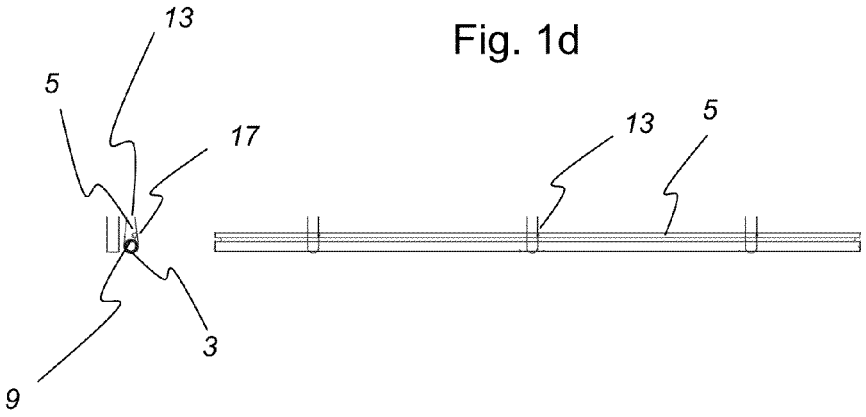
Figure 2A:
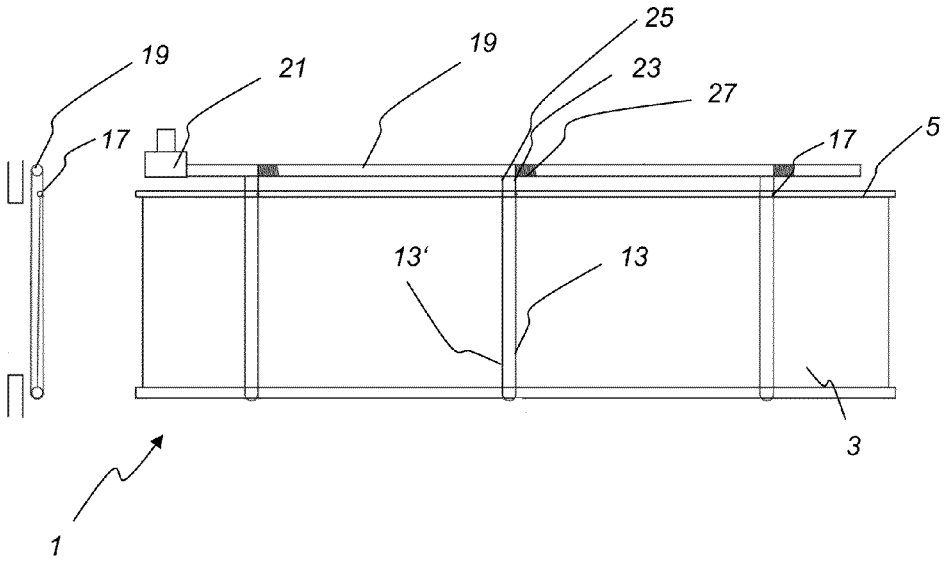
FIGS. 2*a* to 2*d* schematically show the operating mode of another embodiment of a winding device according to the invention, whereby the winding device comprises a shaft.

FIG. 2*a* shows the construction of this embodiment. The free ends 23 and 25 of the cord 13 or 13' are arranged on a shaft 19. The rotation of the shaft is induced by a motor 21. Both free ends 23 and 25 are connected tightly to the shaft 19. A working cord 27 is connected to the shaft 19 in the section of the first free end 23. Unwinding of the working cord 27 from the shaft 19 leads to a downward movement of the cord 13. Analogous to the embodiment shown in FIGS. 1*a* to 1*d*, the cord 13 or 13' is connected to the upper longitudinal edge 5 of the covering element 3 by a connective joint 17.

Figure 2B:
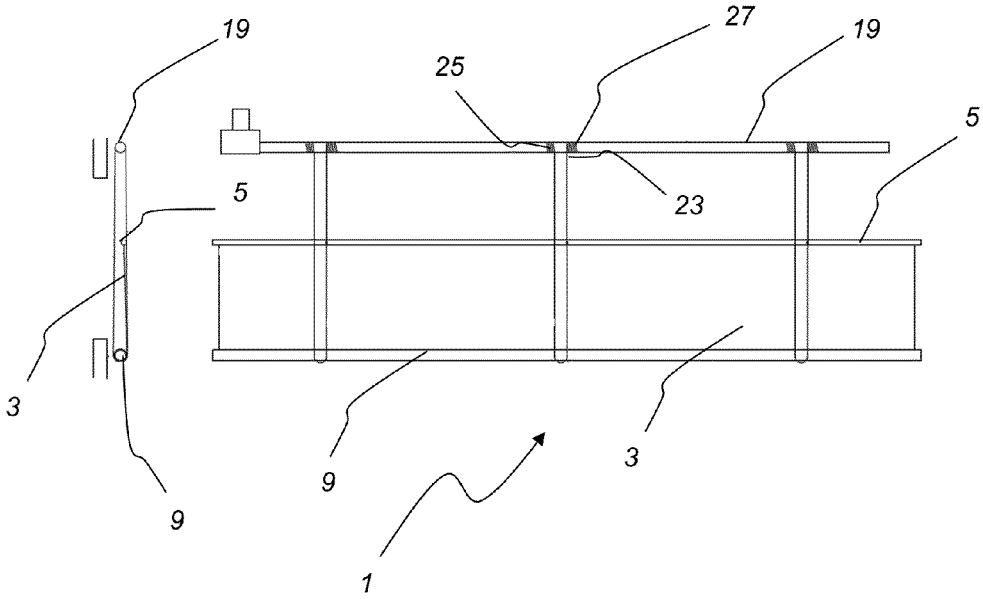
Figure 2C:
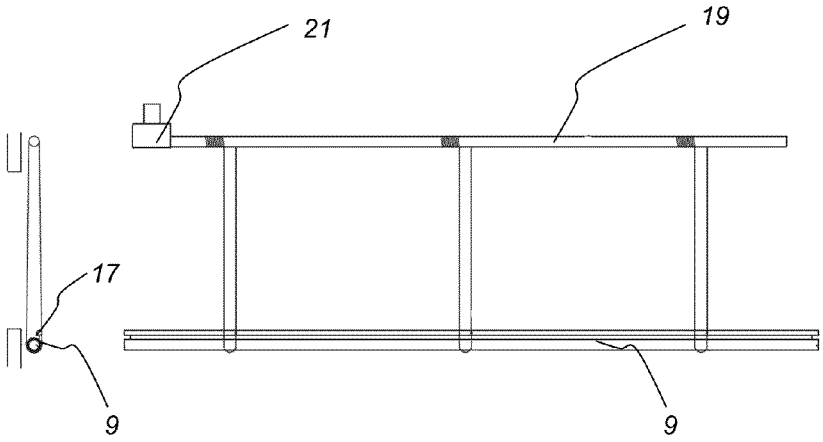

FIGS. 2*b* and 2*c* show the winding of the covering element 3 onto the deflecting element 9, analogous to FIGS. 1*a* to 1*c*.

According to FIG. 2*b* the winding device 1 is only partially open. The shaft 19 is in a rotating state. The working cord 27 is unwound in the section of the first free end 23. The working cord 27 is continued by the deflecting element 9 and then arranged in the section of the second free end 25. The rotation direction of the shaft 19 can be changed by the motor 21. The working rope 27 can thereby be rearranged in the section of the first free end 23. Parallel to the unwinding of the working rope 27 a movement of the upper longitudinal edge 5 along the direction Y (indicated in FIG. 1*a*) occurs. Thereby the covering element 3 is wound up around the deflecting element 9.

Figure 2D:
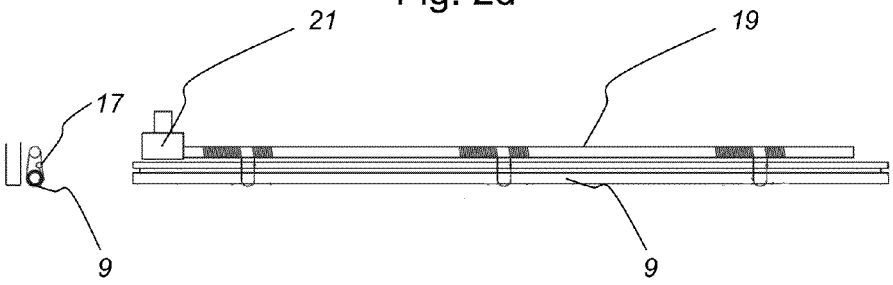

FIGS. 2*c* and 2*d* show a lifting of the deflecting element 9, analogous to FIGS. 1*c* to 1*d*. The lifting is done with the aid of power transmission from the motor 21 to the shaft 19.

Because of the connection of the cord 13 or 13' to the shaft, a further deflecting of the cord 13 from the state shown in FIG. 2*c* is not possible, because in this state the cord 13 is completely unwound. Further rotation of the shaft in the same direction does not lead to further lowering of the cord 13. Instead the cord 13 is now wound up around the shaft. Thereby the wound up covering element 3 is lifted when the two cords 13, 13' are raised.

Figure 2E:
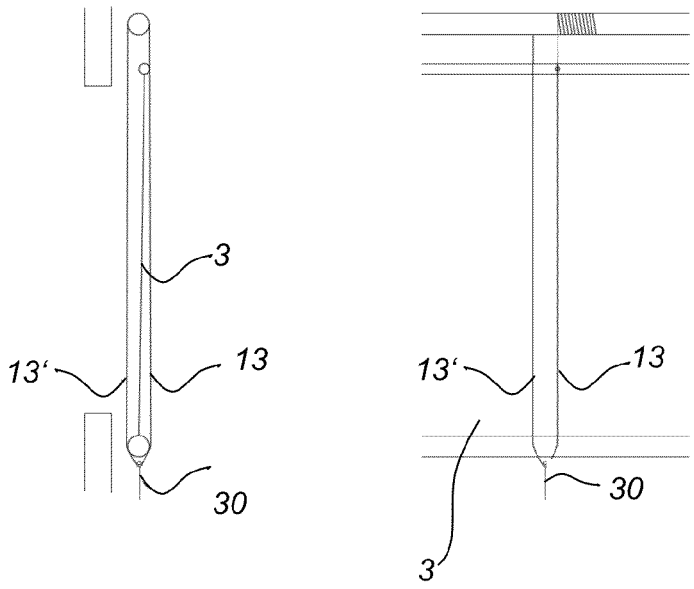
FIG. 2*e* shows an embodiment of the winding device according to the invention with additional wind protecting means.

FIG. 2*e* shows an embodiment according to the invention with an additional guidance of the cord 13, 13'. The cord 13, 13' is especially stabilized by tensioning means 30 each connected to the lowest point of the cord 13, 13'. The cord 13, 13' now performs an additional task by stabilizing the winding device 1 or the covering element 3 when they are subjected to wind or suction loads.

Figure 2F:
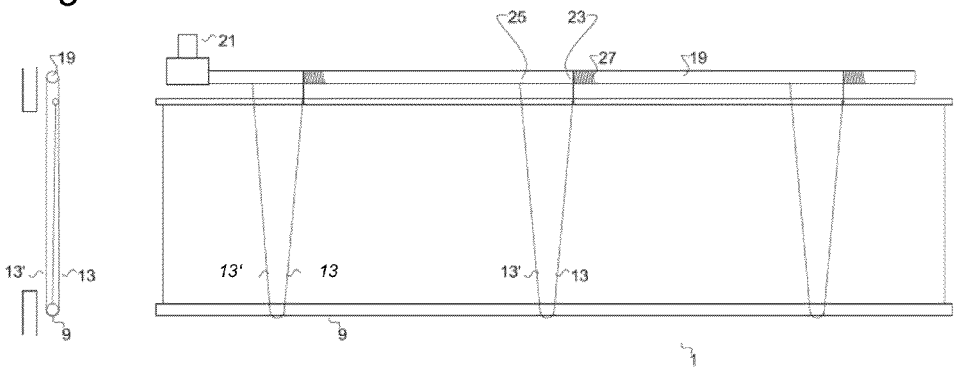
FIG. 2*f* shows an alternative embodiment of the winding device, whereby the cords are guided in a V-shape.

FIG. 2*f* shows the operating mode of another embodiment of a winding device 1 according to the invention, whereby the winding device 1 comprises a shaft 19. The free ends 23 and 25 of cord 13 or 13' are arranged on a shaft 19. The rotation of the shaft is induced by a motor 21. Both free ends 23 and 25 are connected tightly to the shaft 19. The working rope 27 is connected to the shaft 19 in the section of the first free end 23. Unwinding the working rope 27 from the shaft 19 leads to a downward movement of the cord 13. FIGS. 2*b* to 2*c* show the winding of the covering element 3 around the deflecting element 9 analogous to FIGS. 1*b* and 1*c*.

In this embodiment the cords 13, 13' are arranged in a V-shape. This clearly shows that the cords 13, 13' do not necessarily need to run in a parallel arrangement, but can show other arrangements as well, even though the parallel arrangement is especially useful.

Figure 2G:
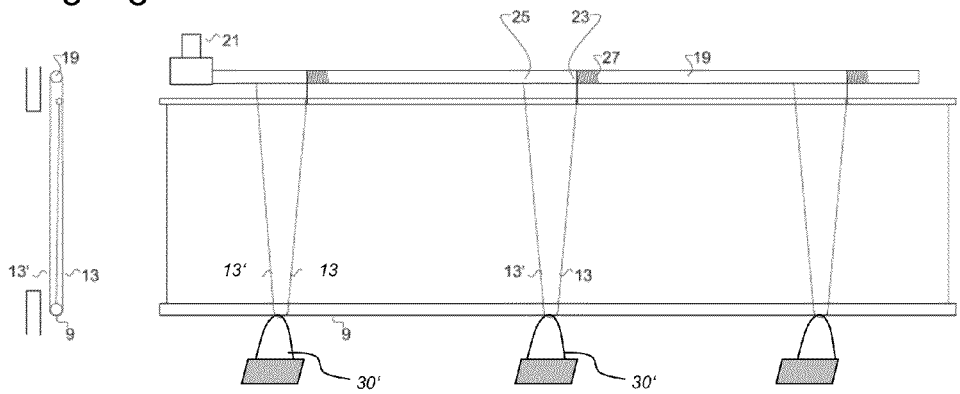
FIG. 2*g* shows an alternative embodiment of the winding device according to FIG. 2*f* with additional wind protecting means.

FIG. 2*g* shows an embodiment of the inventive winding device according to FIGS. 2*e* to 2*f* with an additional guidance of the cord 13, 13' by a tensioning means 30' arranged in the lower bend of the cord.

FIGS. 3*a* to 3*d* schematically show the operating mode of another embodiment of a winding device 1 according to the invention, whereby the winding device 1 comprises a cable pull 29.

In this embodiment the winding and unwinding of the covering element 3 around the deflecting element 9 and the raising and lowering of the deflecting element 9 are controlled by a cable pull mechanism. The cable pull mechanism comprises several deflecting rolls 28 and a cable pull 29. The cord 13 or 13' is guided of the deflecting rolls 28. In the shown embodiment the section of the cord 13 which performs the downward movement, is redirected by the left deflecting roll 28 by an angle of about 270° counter clockwise and then continued.

The section of the cord 13' which performs the upward movement is also guided through the left deflecting roll 28. However, the continuation of cord section 13' is in the direction opposite to the continuation of cord section 13. The deflecting roll 28 located on the right causes the conversion from lowering cord to lifting cord. This is necessary for the change from the operational state shown in FIG. 3*c* to the operational state shown in FIG. 3*d*.

Regarding the embodiment using a cable pull mechanism numerous variations are conceivable in practice. The variations can especially vary in regards to the number and position of the deflecting rolls 28 and the cable pull 29. The cable pull 29 can be either manually or motor-driven.

Figure 3A:
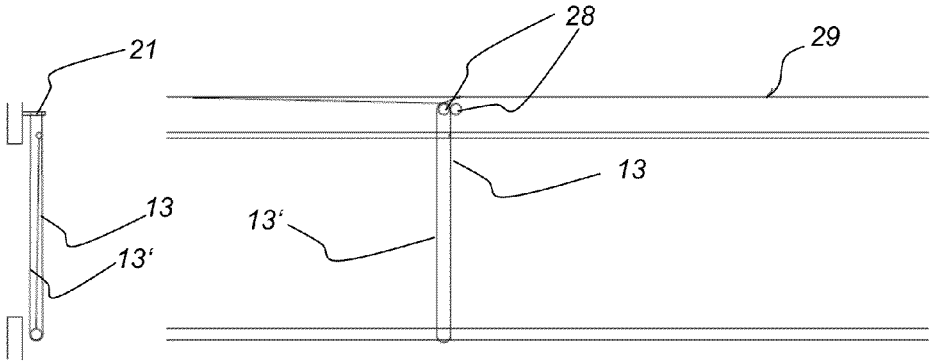
FIGS. 3*a* to 3*d* schematically show the operating mode of another embodiment of a winding device according to the invention, whereby the winding device comprises a cable pull.
Figure 3B:
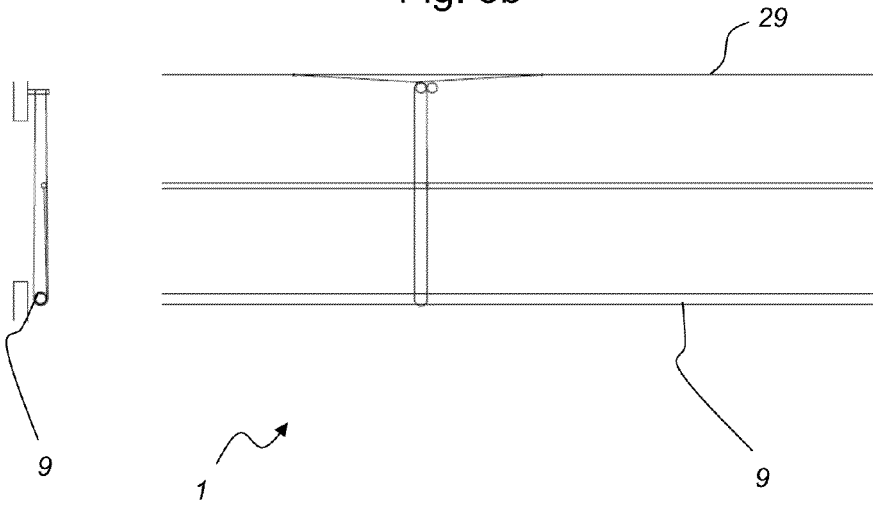
Figure 3C:
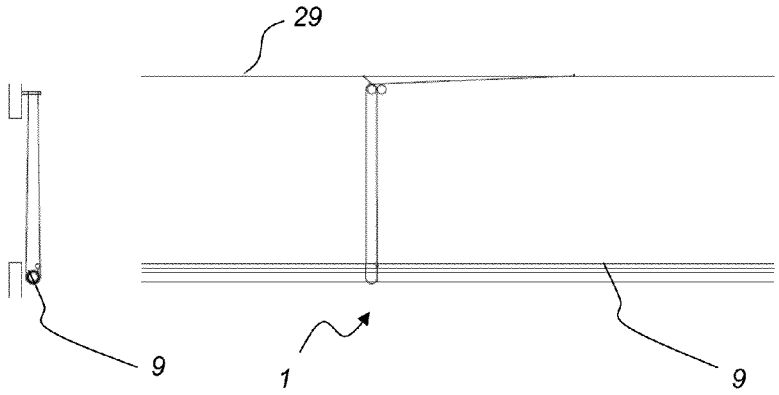

FIGS. 3*b* to 3*c* show the successive steps of transferring the winding device 1 from an open position into an initial position in analogy to FIGS. 1*b* and 1*c* as well as 2*b* and 2*c*.

Figure 3D:
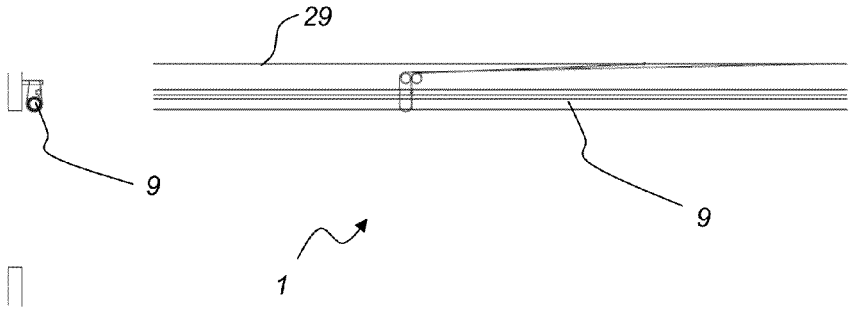

FIGS. 3*c* to 3*d* show the lifting of the deflecting element 9 in analogy to FIGS. 1*c* and 1*d* as well as 2*c* and 2*d*.

FIGS. 4*a* to 4*d* schematically show the operating mode of another embodiment of a winding device according to the invention with first cords 13 and 13' and second cords 31.

As already shown in FIGS. 2*a* to 2*d*, the free ends 23 and 25 of the first cord 13 or 13' are connected tightly to a shaft 19. The device furthermore comprises second cords 31, whereby one free end is tightly connected to the shaft 19. The second free end is tightly connected to the upper longitudinal edge 5 of the covering element 3.

In this embodiment according to the invention a connective joint 17 as shown in FIG. 1*a* to 1*d* can be omitted.

Figure 4A:
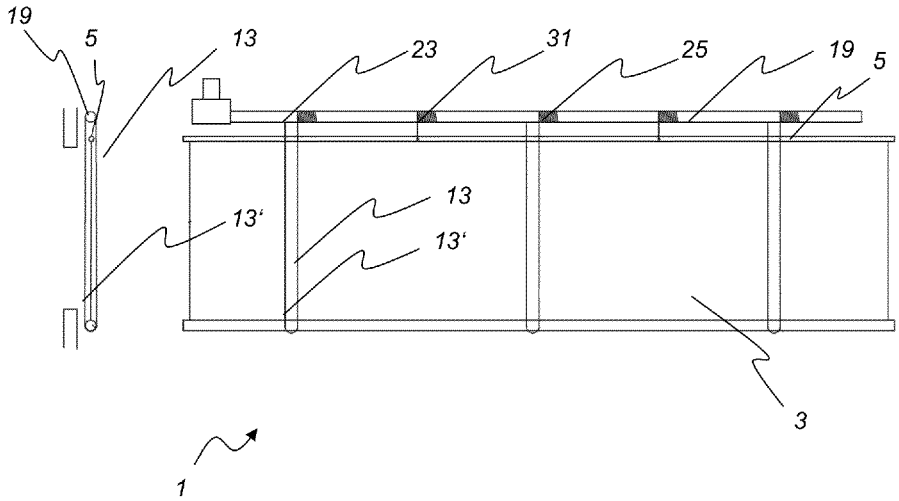
FIGS. 4*a* to 4*d* schematically show the operating mode of another embodiment of a winding device according to the invention with first and second cords.
Figure 4B:
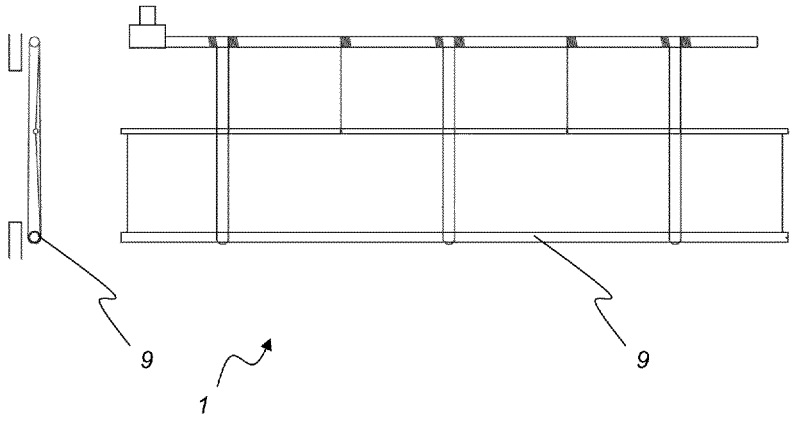
Figure 4C:
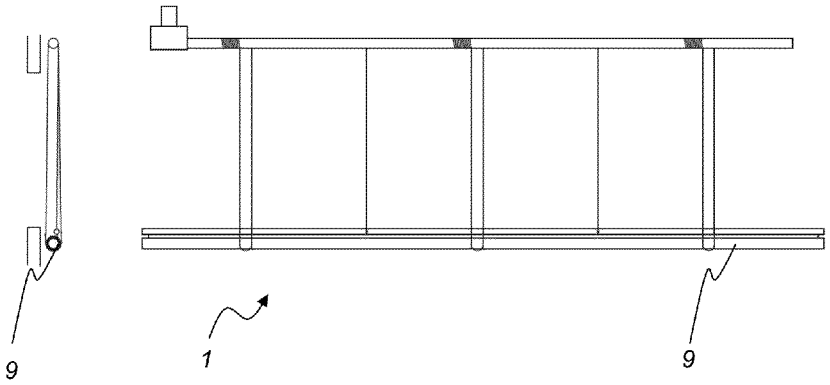

FIGS. 4*b* to 4*c* show the successive steps of transferring the winding device 1 from an open position into an initial position in analogy to FIGS. 1*b* and 1*c*, 2*b* and 2*c* as well as 3*b* and 3*c*.

Figure 4D:
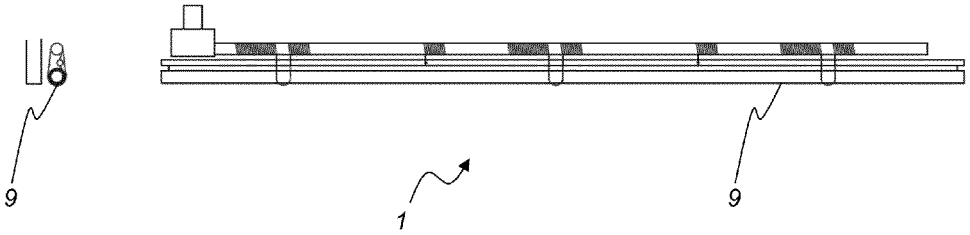

FIGS. 4*c* to 4*d* show the lifting of the deflecting element 9 in analogy to FIGS. 1*b* and 1*c*, 2*b* and 2*c* as well as 3*b* and 3*c*.

FIGS. 5*a* to 5*d* schematically show the operating mode of another embodiment of a winding device 1 according to the invention with first cords 13 and 13' and second cords 31. One free end 23 of the first cord 13' is connected tightly to the shaft 19. The second free end 25 of the first cord 13 is tightly connected with the upper longitudinal edge 5. One free end of the second cord 31 is connected tightly to the shaft 19. The second free end of the second cord 31 is tightly connected with the upper longitudinal edge 5.

Figure 5A:
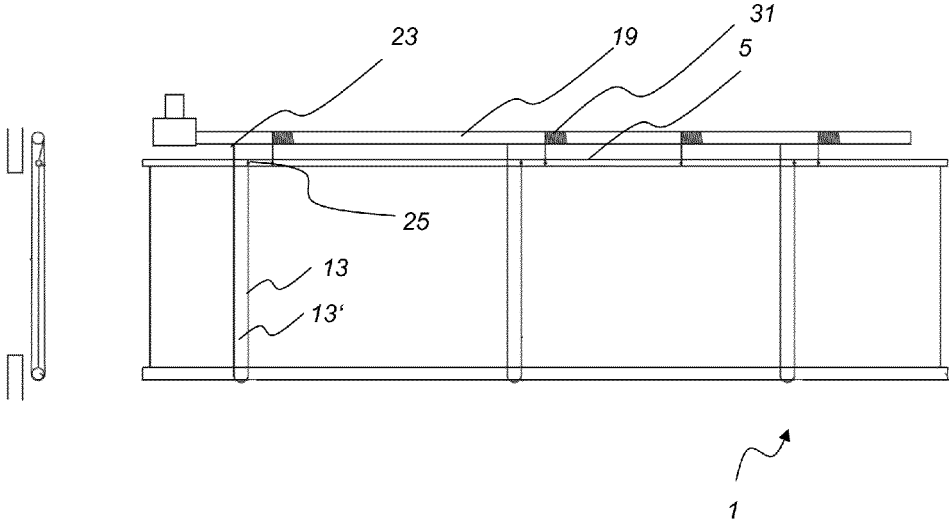
FIGS. 5*a* to 5*d* schematically show the operating mode of another embodiment of a winding device according to the invention with first and second cords.
Figure 5B:
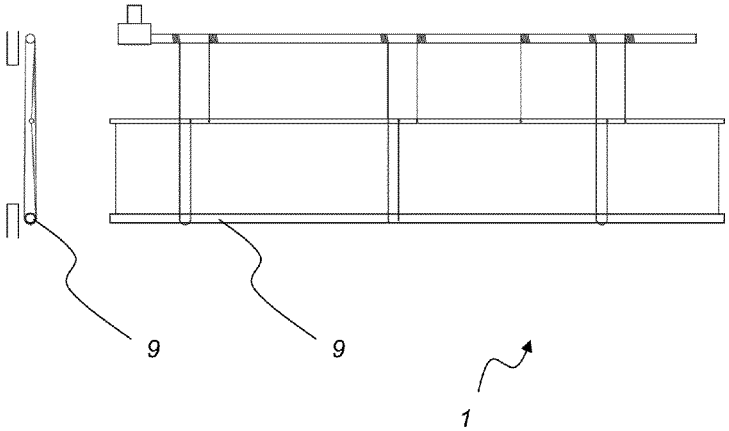
Figure 5C:
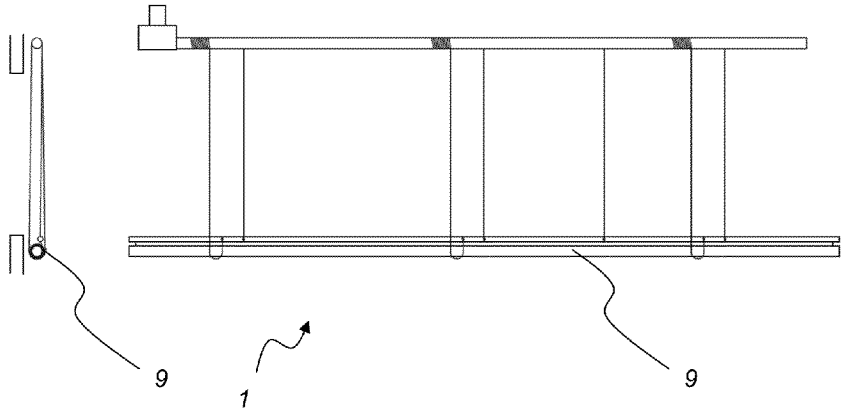

FIGS. 5*b* to 5*c* show the successive steps of transferring the winding device 1 from an open position into an initial position in analogy to the previous figures being "b" or "c".

Figure 5D:
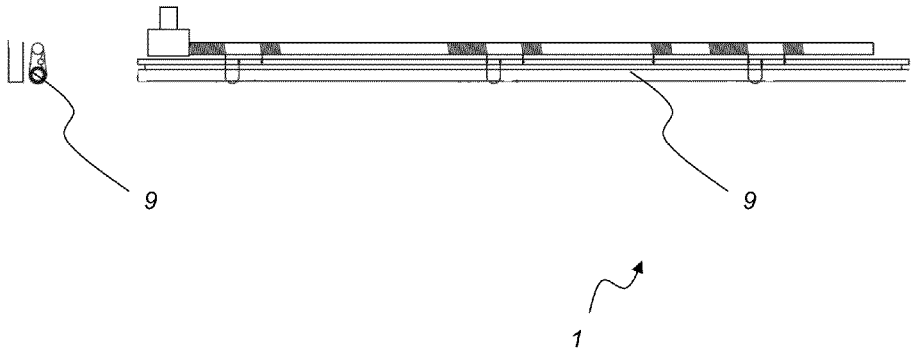

FIGS. 5*c* to 5*d* show the lifting of the deflecting element 9 in analogy to the previous figures being "c" or "d".

It should be emphasized at this point that the deflecting element 9 is not necessarily a rigid element. Furthermore the deflecting element 9 is not necessarily a separate element of the winding device 1 according to the invention. The deflecting element 9 can for instance be formed by the lower hem of the fabric or the bottom edge of the fabric. By the linkage of the lower hem or bottom edge with the windable cords, the hem or edge can be rotated in a defined direction, whereby a relaxed coil is wound or unwound.

Figure 6:
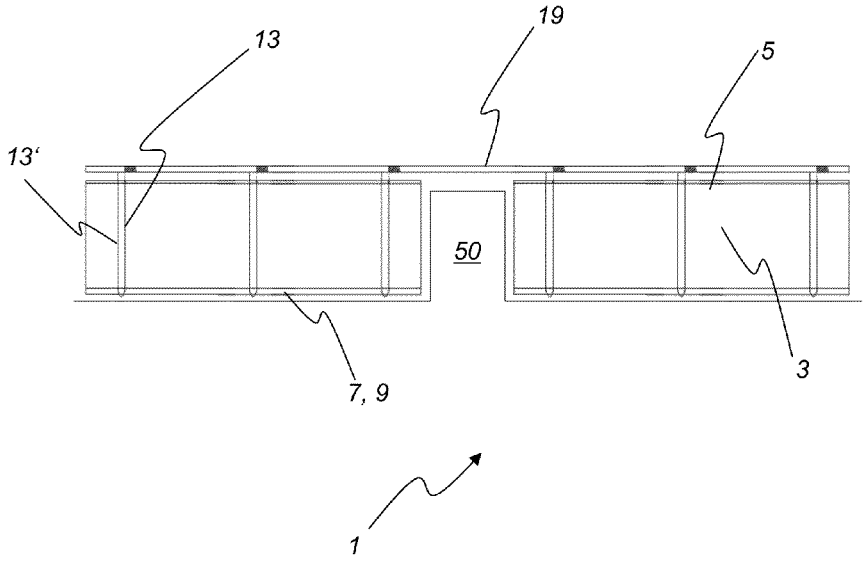
FIG. 6 shows the use of an embodiment of a winding device according to the invention for covering an interrupted opening.

FIG. 6 shows the use of an embodiment of a winding device 1 according to the invention for covering an interrupted opening. The covering element 3 of the winding device 1 can be interrupted by a door or something alike. By using several cords 13, 13' that are distributed over the width of the covering element 3, the functionality described in FIGS. 1 and 2 can be obtained with just one drive, even though the covering element 3 shows an interruption 50.

The functions of the other reference numerals have already been discussed when describing the features shown in FIGS. 1 to 5 and will therefore not be explained again in detail.

FIGS. 7*a* to 7*d* schematically show different embodiments of a winding device 1 according to the invention with optimized cord lengths.

Figure 7A:
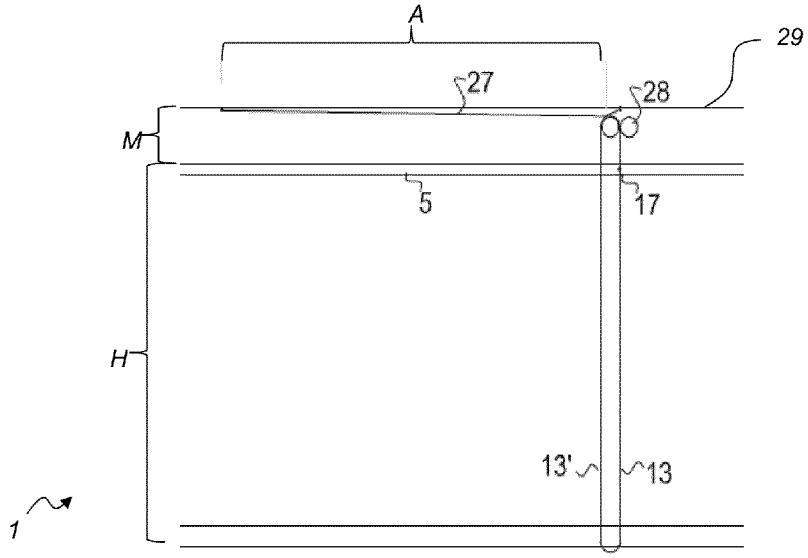
FIGS. 7*a* to 7*d* schematically show different embodiments of a winding device according to the invention with optimized cord lengths.
Figure 7B:
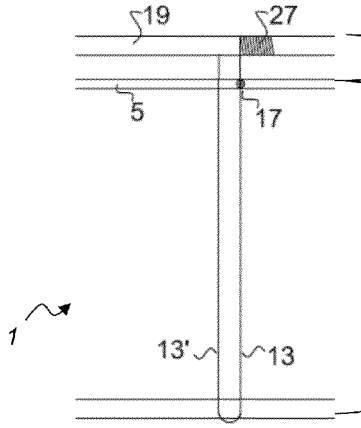

In the embodiments shown in FIGS. 7*a* to 7*b*, both ends of the cords 13, 13' are connected with the raising and lowering unit, especially to the shaft 19 (FIG. 7*b*) or to the cable pull 29 (FIG. 7*a*). In order to achieve the required functionality, the ideal length of the cord 13, 13' corresponds to approximately to the sum of three times the height H of the covering element 3 plus two times the distance M between the upper longitudinal edge 5 of the completely unwound covering element 3 and the raising and lowering unit.

Figure 7C:
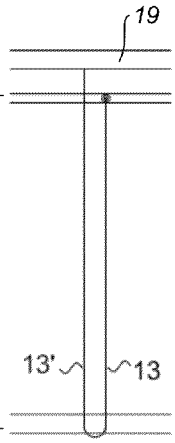

FIG. 7*c* shows an embodiment whereby one end of the cord is connected to the shaft 19 of the raising and lowering unit. The other end of the cord is connected to the upper longitudinal edge 5 of the covering element 3. The cord 13, 13' hereby encloses the covering element. In this embodiment an ideal cord length is sufficient that corresponds approximately to the sum of two times the height H of the covering element 3 plus one times the distance M between the upper longitudinal edge 5 of the completely unwound covering element 3 and the raising and lowering unit.

Figure 7D:
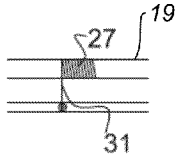

The embodiment according to FIG. 7*d* shows the ideal length of a second cord 31. One end of the second cord is connected to the shaft 19 of the raising and lowering unit. The other end is connected to the upper longitudinal edge 5 of the covering element 3. The cord 31 does not enclose the covering element but is connected directly to the upper longitudinal edge 5. The ideal length of the cord 31 corresponds approximately to the sum of one times the height H of the covering element 3 plus one times the distance M between the upper longitudinal edge 5 of the completely unwound covering element 3 and the raising and lowering unit.

All representations of FIGS. 7*a* to 7*d* furthermore show an advantageous working cord length 27. In the position shown in the figures the covering element 3 is completely unwound, covering the opening. In this position the stretched working cord length 27 (in case of a cable pull mechanism) or wound-up working cord length 27 (in case of a shaft) corresponds approximately to the height H of the covering element 3.

The invention has been described with reference to preferred embodiments. To the expert it is also conceivable, however, to make changes and modifications without leaving the scope of protection of the appended claims.

LIST OF REFERENCE NUMBERS

1 winding device
3 covering element
5 upper longitudinal edge
7 bottom longitudinal edge
9 deflecting element
11 wall opening
13 cord in a downward movement
13' cord in an upward movement
17 connective joint between cord and upper longitudinal edge
19 shaft
21 motor
23 first free end of the first cord
25 second free end of the first cord
27 working cord
28 deflecting roll
29 cable pull
30 tensioning means
30' tensioning means
31 second cord
50 interruption
A side view of winding device
B front view of winding device
X first vertical movement direction
Y second vertical movement direction
Z vertical axis

I claim:

1. A winding device for covering at least one of wall openings and windows comprising:

a covering element that can be wound up, the covering element including at least an upper longitudinal edge and a bottom longitudinal edge;

at least one raising and lowering unit comprising one of a shaft and a cable pull with a plurality of guiding rolls, and a drive unit enabling one of a rotational movement of the shall about a horizontal axis in two opposite rotational movement directions and a horizontal movement of the cable pull in two opposite movement directions; and wherein the bottom longitudinal edge of the covering element is one of connected to the deflecting element and forms the deflecting element, at least one first cord encloses the covering element and the one of the deflecting element and the bottom longitudinal edge of the covering element, and guides a rotational movement of the one of the deflecting element and the bottom longitudinal edge of the covering in a bend of the at least one first cord in the two opposite movement directions, the winding device comprising the at least one first cord, the at least one first cord having at least one free end connected to one of a shaft and a cable pull of the at least one raising and lowering unit and the winding device moving the at least one first cord in two opposite movement directions, wherein when the winding device moves the at least one first cord in one of the two opposite movement directions, the one of the deflecting element and the bottom longitudinal edge of the covering element rotates in one of the two opposite rotational movement directions to one of wind and unwind the covering element from the one of the deflecting element and the bottom longitudinal edge of the covering element, and at the same time one of lower and raise the upper longitudinal edge of the covering element.

2. The winding device according to claim 1, wherein the at least one first cord is one of guided through a tensioning device and fixed by the tensioning device.

3. The winding device according to claim 1, wherein the length of the at least one first cord corresponds approximately to one of the sum of three times the height (H) of the covering element plus two times the distance (M) between the upper longitudinal edge of the completely unwound covering element and the raising and lowering unit, and the sum of two times the height (H) of the covering element plus one times the distance (M) between the upper longitudinal edge of the completely unwound covering element and the raising and lowering unit.

4. The winding device according to claim 1, wherein after a first rotation around the one of the deflecting element and the bottom longitudinal edge of the covering element, a rotational velocity of the covering element around the one of the deflecting element and the bottom longitudinal edge of the covering element is automatically adjusted according to a velocity of the at least one first cord.

5. The winding device according to claim 1, wherein the at least one first cord is connected to the upper longitudinal edge of the covering element via a connective joint.

6. The winding device according to claim 1, wherein the drive unit is a crank connected directly to the shaft of the at least one raising and lowering unit, and the crank is manually operated to rotate the shaft for raising and lowering the covering element.

7. The winding device according to claim 1, wherein the drive unit is a crank connected directly to the cable pull of the at least one raising and lowering unit, and the crank is manually operated to move the cable pull horizontally for raising and lowering the covering element.

8. The winding device according to claim 1, wherein the drive unit is a motor to rotate the shaft of the at least one raising and lowering unit for raising and lowering the covering element.

9. The winding device according to claim 1, wherein the drive unit is a motor to move the cable pull horizontally for raising and lowering the covering element.

10. The winding device according to claim 1, wherein the shaft of the at least one raising and lowering unit is positioned above the upper longitudinal end of the covering element in a vertical direction when installed.

11. The winding device according to claim 1, wherein the cable pull and at least some of the plurality of guiding rolls of the at least one raising and lowering unit are positioned above the upper longitudinal end of the covering element in a vertical direction when installed.

12. The winding device according to claim 1, wherein the deflecting element has a wave-like design having one of guiding grooves and radial grooves for guiding the at least one first cord.

13. The winding device according to claim 1, wherein the covering element further comprises two of more openings spaced from each other along a horizontal length of one of the deflecting element and the bottom longitudinal edge of the covering element, and a single drive unit rotates the one of the deflecting element and the bottom longitudinal edge of the covering element in two opposite rotational movement directions to wind and unwinding the covering element and lowers and raises the upper longitudinal edge of the covering element.

14. The winding device according to claim 13, wherein the one of the deflecting element and the bottom longitudinal edge of the covering element can be raised when only a portion of the covering element is wound onto the one of the deflecting element and the bottom longitudinal edge of the covering element.

15. A winding device for a covering for at least one of wall openings and windows comprising:

a covering element that can be wound, the covering element including at least an upper longitudinal edge and a bottom longitudinal edge;

at least one raising and lowering unit comprising one of a shaft and a cable pull with a plurality of guiding rolls, and a drive unit enabling one of a rotational movement of the shaft about a horizontal axis in two opposite rotational movement directions and a horizontal movement of the cable pull in two opposite movement directions; and the winding device comprising at least one first cord, the at least one first cord having one free end connected to one of the shaft and the cable pull of the at least one raising and lowering unit, and a second free end connected to the upper longitudinal edge of the covering element;

wherein the bottom longitudinal edge of the covering element is one of connected to a deflecting element and forms a deflecting element, and the at least one first cord encloses the covering element and one of the deflecting element and the bottom longitudinal edge of the covering element, and wherein when the winding device moves the at least one first cord in one of the two opposite movement directions, only the upper longitudinal edge of the covering element one of raises and lowers.

16. A winding device for a covering for at least one of wall openings and windows comprising:

a covering element that can be wound, the covering element including at least an upper longitudinal edge and a bottom longitudinal edge;

at least one raising and lowering unit comprising at least a shaft and a drive unit enabling a rotational movement of the shaft about a horizontal axis in two opposite rotational movement directions; and the winding device comprising at least one first cord, the at least one first cord having at least one free end connected to the shaft of the at least one raising and lowering unit, and the winding device moving the at least one first cord in two opposite movement directions, wherein the bottom longitudinal edge of the covering element is one of connected to a deflecting element and forms a deflecting element, and the at least one first cord encloses the covering element and one of the deflecting element and the bottom longitudinal edge of the covering element, and guides a rotational movement of the one of the deflecting element and the bottom longitudinal edge of the covering in a bend of the at least one first cord element in the two opposite movement directions, and wherein when the winding device moves the at least one first cord in one of the two opposite movement directions, the one of the deflecting element and the bottom longitudinal edge of the covering element rotates in one of the two opposite rotational movement directions to one of wind and unwind the covering element from the one of the deflecting element and the bottom longitudinal edge of the covering element, and at the same time one of raise and lower the upper longitudinal edge of the covering element.

17. A winding device for a covering for at least one of wall openings and windows comprising:

a covering element that can be wound, the covering element including at least an upper longitudinal edge and a bottom longitudinal edge;

at least one raising and lowering unit comprising a cable pull and a plurality of guiding rolls, and a drive unit enabling a horizontal movement of the cable pull in two opposite movement directions; and the winding device comprising at least one first cord, the at least one first cord having at least one free end connected to the cable pull of the at least one raising and lowering unit, and the winding device moving the at least one first cord in two opposite movement directions, wherein the bottom longitudinal edge of the covering element is one of connected to a deflecting element and forms a deflecting element, and the at least one first cord encloses the covering element and one of the deflecting element and the bottom longitudinal edge of the covering element, and guides a rotational movement of the one of the deflecting element and the bottom longitudinal edge of the covering in a bend of the at least one first cord element in the two opposite movement directions, and wherein when the winding device moves the at least one first cord in one of the two opposite movement directions, the one of the deflecting element and the bottom longitudinal edge of the covering element rotates in one of the two opposite rotational movement directions to one of wind and unwind the covering element from the one of the deflecting element and the bottom longitudinal edge of the covering element, and at the same time one of raise and lower the upper longitudinal edge of the covering element.

* * * * *